US005441273A

United States Patent [19]

Stormon

[11] Patent Number: 5,441,273

[45] Date of Patent: Aug. 15, 1995

[54] GOLF CLUB PUTTER FITTING TOOL AND STROKE ANALYZER

[76] Inventor: Robert D. Stormon, 2103 Divot La., Palm Springs, Calif. 92264

[21] Appl. No.: 215,632

[22] Filed: Mar. 22, 1994

[51] Int. Cl.[6] ..... A63B 69/36

[52] U.S. Cl. ..... 273/187.4; 273/163 A

[58] Field of Search ..... 273/164.1, 183.1, 187.4, 273/163 R, 163 A

[56] References Cited

U.S. PATENT DOCUMENTS

| | | | |
|---|---|---|---|
| 2,670,209 | 2/1954 | Fay | 273/163 R |
| 3,667,761 | 6/1972 | Palotsee | 273/186.1 |
| 4,167,268 | 9/1979 | Lorang | 273/163 A |
| 4,306,721 | 12/1981 | Doyle | 273/163 R |
| 4,575,090 | 3/1986 | Heseltine | 273/183 D |
| 4,789,158 | 12/1988 | Chiesa | 273/163 A |
| 4,927,144 | 5/1990 | Stormon | 273/80 A |
| 4,953,867 | 9/1990 | Rigsby | 273/183 D |
| 5,052,690 | 10/1991 | Sharp | 273/183 D |
| 5,071,129 | 12/1991 | Wilson | 273/183 D |
| 5,156,401 | 10/1992 | Hodgkiss | 273/186.2 |

*Primary Examiner*—William H. Grieb

[57] ABSTRACT

The putter fitting tool and stroke analyzer, called the "fitting tool", is to custom fit a golf club putter to match the composite physical stature and preferred stroking posture of an individual golfer. The tool's lie angle indicator marks when aligned between the eyes and putterhead sight or ball striking point, makes a 90 degree sight plane to the target called "sight plane". The putter is adjusted in manufacturing to match the sight plane specified by the tool. The preferred sight of the system is specially constructed to duplicate the desired sight plane once the tool is removed. This allows the golfer to putt from the same stroking position every time. The sight plane indicator marks or lie angle marks of the tool allow the golfer to try-a variety of sight planes to select the one most suited to his putting posture. The tool, as a stroke analyzer, magnifies deviations from the sight plane (the "sight plane" is the plane which intersects the clubhead, target, and golfer's eye) during the stroke. The tool has additional marks to indicate the adjustment the manufacturer uses to compensate for a putter sight location difference between the putter used for fitting and the putter the consumer is ordering. The fitting tool consists of the following: a rod with lie angle or sight plane indicator marks, a finger nut, a flange nut, and a loop clamp.

3 Claims, 2 Drawing Sheets

GOLF CLUB PUTTER FITTING TOOL AND STROKE ANALYZER

BRIEF SUMMARY OF THE INVENTION BACKGROUND AND OBJECTIVES

This invention relates to a removable attachment to golf clubs, and more particularly a putter, or similar club. Unlike many other attachments that aid in aligning the putter head in the direction of the target, this invention aids in (1) the proper fitting of the putter to the golfer, and (2) in analyzing a golfer's ability to maintain, during the course of his (her) stroke, his (her) stroke plane alignment.

It is an objective of my invention to secure for the golfer the added accuracy that is achieved from putting from the same and desired stroking position every time. There are a variety of individual statures, styles, stances, and preferences that vary the angle between the golfer's sight plane and the ground from golfer to golfer. Despite the different angles between each of their sight planes and the ground, each golfer should, and can, through use of the putter fitting tool and stroke analyzer, create the desired stroking position, that is a 90 degree angle, in the sight plane, between the line created by the intersection of eye, fitting tool and putterhead, and the target line along the ground. Each golfer has his own "unique" sight plane, as described above, based upon the following controlling variables: (1) The length from the putterhead to where the shaft is gripped by the hands; and (2) the angle created at the hands between the putterhead and the eyes.

I think that it is important that my invention follow my design concept. Briefly, I disagree with the widely held belief of golf experts that each golfer's sight plane should be perpendicular to the ground, that is, that having the eyes directly over the ball is the preferred position to putt from. Utilizing this assumption, other manufacturers can then fit the golfer to the club instead of the club to the golfer for obvious production reasons. Therefore, the clubs they produce have no visual reference point to establish when the putterhead is perpendicular to anything. Installing my fitting tool at a specific distance from the upper surface of the putterhead allows the golfer to have a gauge intersecting the line of sight to the ball striking point, controlled by the putterhead-handgrip-eye angle.

My patent, U.S. Pat. No. 4,927,144, Robert D. Stormon May 22, 1990, has a sight on the putterhead that visually aligns the eyes perpendicular to the target. This is done by varying the elevation in the design of a sight, so that it becomes optically straight from only the perpendicular or 90 degree position from the eyes to the target, on the line the ball travels. In nearly every case, the desired stroking position leans the 90 degree sight plane toward the golfer, occasionally as much as 20 degrees inside the vertical position from the club head. The significance being, if the putterhead lie angle is not adjusted to match the line to the target, the stroke must be manipulated to some degree to compensate. Putting under this circumstance, the natural tendency is to alter the line in mid-stroke, especially on short putts. Explanation being, the golfer sees that the stroke must follow the line from the ball to the target, but the natural stroke is from the eye to the target. To further complicate the compensation, the body's balance is set to gravity, and if the terrain is sloping away from the golfer's toes, the eyes will be even further inside the line from the clubhead to the target and vice-versa when the opposite slope is encountered. This condition is less noticeable on longer putts because the two separate planes to the target become more parallel viewed over the longer distances. The 90 degree sight plane provides a positive way of repeating the same predetermined and desired stroking position. The fitting tool allows golfers of any stature, whether they play with their eyes over the ball or not, to find their desired stroking position, and the manufacturer focuses the lie angle of the putterhead to the sight plane of that position.

There are two anticipated uses of the invention:

1. My fitting tool is a device which, when attached to the shaft of a golf putter, allows the golfer to experiment with a variety of exact shaft angles and gripping lengths without physically changing the lie angle of the clubhead. Using the sight plane indicator marks over the sight or point where the clubhead strikes the ball. The user can settle on the most suitable position and shaft length combination for the desired stroke. He now has the exact indicated adjustment necessary to order a custom fit club.

2. When the fitting tool is used as a stroke analyzer, it allows the golfer to more easily detect and correct any deviation from the desired path of the clubhead during the stroke. The location of the fitting tool amplifies the deviations. The clubhead will travel precisely on the intended target line when the golfer visually maintains both the latitude and the longitude of the sight plane indicator mark, using the eye as the pivot (axis), through the stroke. With practice, this tool adds a new dimension that aids in the development of what it takes to support the weight of the club at the shaft angle that has been selected and improve the senses for better control when the device has been removed.

I think it is important to achieve the following characteristics in a fitting tool and stroke analyzer.

(a) To provide a device with indicator markings that parallel the sight plane on a putter with a 90 degree sight plane sight. This enables the golfer to duplicate the same positioning after the device is removed from the shaft for play rather than practice.

(b) To provide a device that attaches to any putter to create a 90 degree sight plane with the device, allowing the golfer to read the exact lie angle required to convert the position to the putter that I invented with the 90 degree sight plane sight.

(c) To provide a device that is light in weight to have a minimal effect on the balance of the club while it is attached.

(d) To provide a tool to the consumer at a very modest cost, which allows a golfer of modest means to obtain a properly custom fit putter directly from the manufacturer and/or use of the tool to analyze his (her) stroke and improve his (her) putting ability to the extent the tool by itself allows.

(e) When the fitting tool is installed on my putter with the proper lie angle of the putterhead selected, but new to the golfer purchasing it, the fitting tool allows the consumer to check that the 90 degree sight becomes straight at the proper point on the fitting tool's scale.

My fitting tool will be best understood, together with additional advantages and objectives thereof, when read with reference to the drawings.

Definition: Indicator marks on the rod are referred to as "lie angle" marks, or "sight plane" marks, to more clearly depict whether they are being used by the manufacturer to adjust the club head lie angle or the sight plane to the golfer in this text.

DRAWINGS

FIG. 1 is a side view in one dimension taken of a golfer in stick form with putter and my fitting tool attached. A comparison between the illustrations of FIG. 1, demonstrates the focus and value of my invention. Line 34—34 indicates line of sight to putter sight, line 32 is a right angle from line 34.

DESCRIPTION

Figure 1:
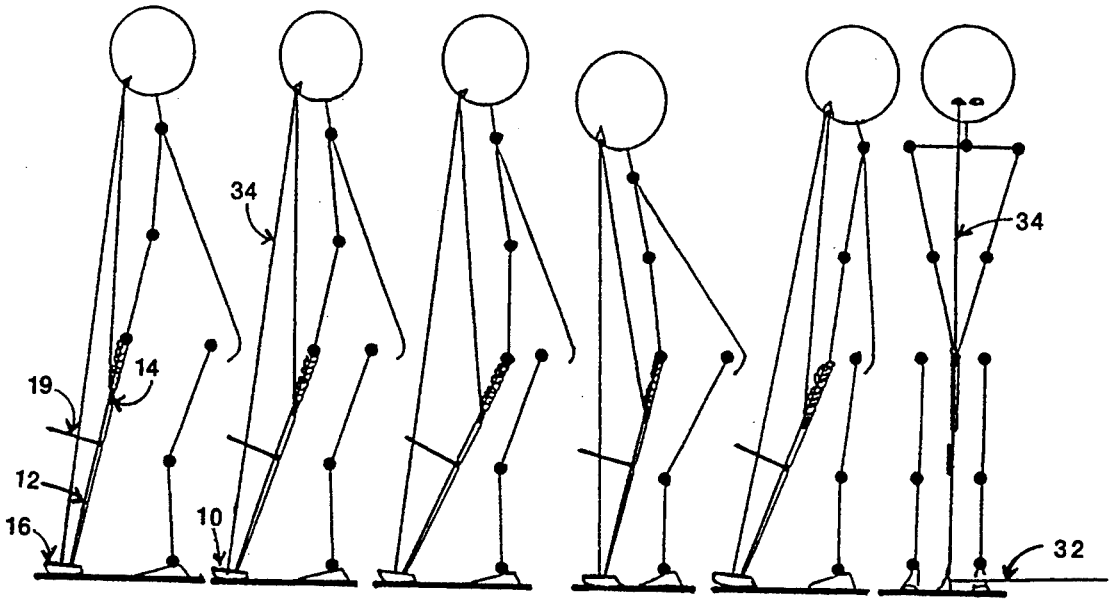

To provide orientation, I will first list some parts of my putter 10 that are in common with other golf clubs and putters. An elongated shaft 12 has a grip 14 at its upper end, and shaft 12 is attached to a clubhead 16, has a heel end 18, a toe end 20, an upper surface 24, and face 26.

I will now list the parts of my fitting tool 19. An elongated rod 11 is partially threaded from one end. There are a series of 6 different (colored) rings in a calibrated location inscribed around the rod 11 beginning near the unthreaded end and continuing at intervals toward the threaded end of rod 11. There are three more calibration rings inscribed at the threaded end of the rod 11, beginning immediately next to the bottom thread and continuing in two equal measurements toward the unthreaded end of rod 11. Additional parts, include a finger nut 13, a flange nut 15, a clamp 17, sight plane indicator marks 21, and calibration marks 23.

The procedure in installing the parts of my fitting tool 19 to shaft 12. Clamp 17 is expanded over shaft 12 from the face 26 side in a manner that the longest flat portion of clamp 17 is to the clubhead 16 side of shaft 12. The holes of clamp 17 are located to the right front of the shaft 12 from the address position for a right handed golfer, and to the left for a left handed golfer. Flange nut 15 is screwed to the bottom of the threads on rod 11 in a manner that allows the flange side to grip clamp 17. The threaded end of rod 11 is inserted through the holes in clamp 17 from the clubhead 16 side. Finger nut 13 is started over the threads of rod 11. The lower edge of clamp 17 is elevated along shaft 12 to a point nearer grip 14 then upper surface 24. Fitting tool 19 is rotated around shaft 12 until rod 11 is parallel to face 26 along heel/toe axis of putterhead 16. Finger nut 13 is now tightened to hold the fitting tool 19 in position.

The location clamp 17 is elevated along shaft 12 from upper surface 24 is a significant measurement that is critical to the scale used for the distance between the lie angle or sight plane marks on rod 11. Furthermore, the fitting tool 19 described is attached to an inclining plane shaft 12. The location of fitting tool 19 is further preferred because the range of desired lie angles are encompassed within the length of the scale used for the markings on rod 11. When the fitting tool 19 is installed on my putter 10 with the proper lie angle selected but, new to the golfer purchasing it. The fitting tool 19 allows the golfer to check that the 90 degree sight plane sight becomes straight at the point on the scale of rod 11, which putter 10 was ordered to match.

Having described my fitting tool 19, note the golfer of FIG. 1 viewed in parallel. It shows the angle of the major joints for comparison. I have altered only the angle of the shoulder, elbow, and wrist joints. From FIG. 1, position (a) to (b), and to (c). Note the different locations the line between the eye and the sight crosses rod 11. It depicts three very different lie angle adjustments necessary to accommodate the same sight plane. A comparison between position (d) and (e) illustrates two very different sight planes with the same lie angle indicated for the club head. Position (f) is a front view of the golfer to show the 90 degree sight plane extended toward the target, even though it may be tipped a different amount from one position to the next in FIG. 1 position (a), (b), (c), (d), (e). In summary, as the angles of the skeleton flex points (joints) change or the length shaft 12 is gripped from the club head changes, the proper lie angle may change, as may the individual golfer's sight plane. The significance being the shaft length and the composite of the desired body position, creates an intersection point at a sight plane mark of rod 11. The indicated point simultaneously matches the lie angle adjustment for the proper sight plane to whatever position is taken.

Figure 2:
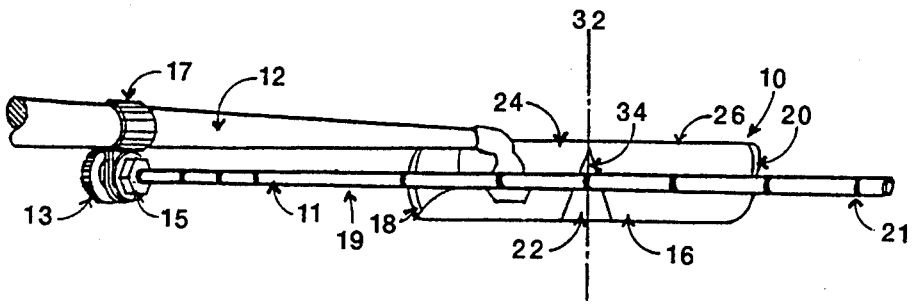
FIG. 2 is a top view taken on Line 34—34 of FIG. 1, position B. With the putterhead and preferred line of the stroke shown as viewed from the eyes of the golfer.
Figure 3:
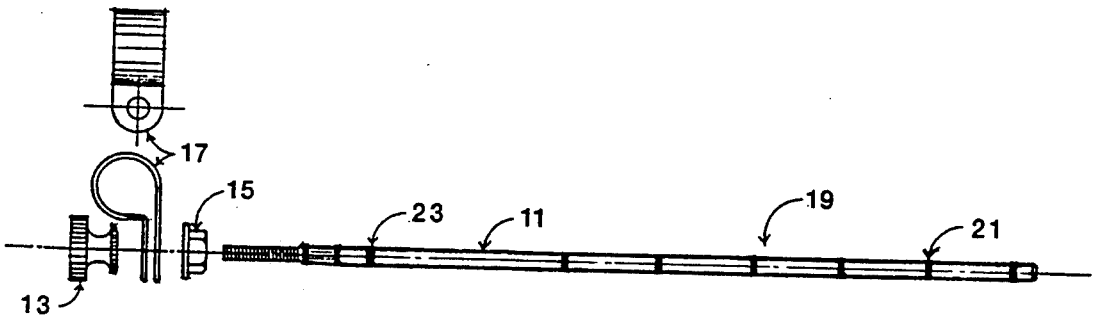
FIG. 3 is an exploded perspective view of the fitting tool and the parts thereof.
Figure 4:
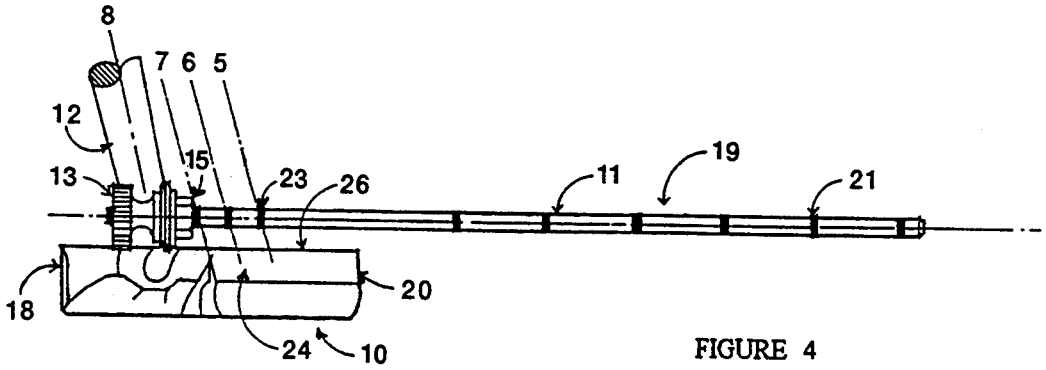
FIG. 4 is a perspective view taken in alignment with the center line of the shaft Line 8—8.

The calibration alignment mark 23, of line 7—7 on FIG. 4 is the position of the sight on putter 10 from fitting tool 19. Other putters may have ball striking areas that do not match this alignment. Therefore, the alignment distance from line 5—5, line 6—6, or line 7—7 indicate the adjustment necessary to match the lie angle taken from other putters when ordering putter 10. A comparative view of FIG. 2 and FIG. 4 sight 22 illustrates the 90 degree sight plane sight as viewed from an angle in FIG. 4.

Having thus described my invention, I do not wish to be understood as limiting myself to the exact details shown and described herein. Instead, I wish to also cover those modifications thereof which also will occur to those skilled in the art, and which properly are within the scope of my invention.

I claim:

1. An apparatus for gauging the adjustment necessary to alter a golf putter's (club's) lie angle to provide a 90 degree sight plane to match a golfer's desired stance at address and during the stroke, said apparatus comprising in combination: a putter including a head, a handle, and a shaft connecting the head to the handle; and said head comprising in part; a face and a sight point on the upper surface; an indicator means including means for detachable mounting the indicator means to the said shaft; a clamping means comprising in combination; the threaded end of a indicator rod and an offset clamp that may be inverted to accommodate a right or left dominant eye, said mounting means is adjustably elevated along the said shaft's inclining plane to a prescribed distance from the said head, then rotated normally around said shaft to project said indicator rod visually parallel to said face and secured by said clamping means for viewing the indicated lie angle indicator mark on a line of sight between the eye and the said sight point.

2. A apparatus as defined in claim 1, said apparatus a stroke analyzer to visually assist a golfer in the feel of sustaining the weight of said head at the desired lie angle through the stroking motion.

3. A apparatus as defined in claim 1, said apparatus to duplicate the lie angle indicated from another style of putter in a remote location with a said sight point unknown, located by special indicator marks on said indicator rod to complete the specifications to adjust a putter or manufacture a custom fit putter's lie angle.

* * * * *